United States Patent [19]

Schurch

[11] 3,981,410

[45] Sept. 21, 1976

[54] RIGID, COLLAPSIBLE AND NESTABLE CONTAINER

[75] Inventor: Richard Charles Schurch, Livonia, Mich.

[73] Assignee: Armco Steel Corporation, Middletown, Ohio

[22] Filed: Dec. 19, 1975

[21] Appl. No.: 642,310

[52] U.S. Cl. ..... 220/6; 220/1.5; 206/511

[51] Int. Cl.[2] ..... B65D 7/24; B65J 1/02

[58] Field of Search ..... 220/7, 6, 4 F, 1.5; 206/503, 504, 509, 511, 512; 217/13, 15, 43, 45, 47

[56] References Cited

UNITED STATES PATENTS

| | | | |
|---|---|---|---|
| 2,756,894 | 7/1956 | Phillips | 220/6 |
| 2,780,382 | 2/1957 | Beckner et al. | 220/6 |

*Primary Examiner*—William Price
*Assistant Examiner*—Steven M. Pollard
*Attorney, Agent, or Firm*—Melville, Strasser, Foster & Hoffman

[57] ABSTRACT

A rigid, collapsible and nestable container is disclosed. The container is characterized by a rectangular deck having corner posts extending from each corner thereof. Each corner post includes a vertical lower section having male nesting means depending therefrom and female nesting means at its top. Upper corner post sections, also having female nesting means at one end thereof, pivotally engage respective lower sections and are swingable between a vertical position and a substantially horizontal position overlying the deck. A pair of side panels extend between and are each pivotally associated with two of the corner posts. Front and rear panels extend between the side panels in hinged relationship with the deck so as to be swingable between a vertical position and a substantially horizontal position overlying the deck. The container is fully collapsible for storage or shipment and is nestable both when fully collapsed and when fully erect.

10 Claims, 16 Drawing Figures

RIGID, COLLAPSIBLE AND NESTABLE CONTAINER

BACKGROUND OF THE INVENTION

This invention relates to a welded wire container of the type used by various industries to store and transport small parts.

Frequently, industries such as the automotive industry, as well as farm implement and appliance industries, finally assemble a finished product, e.g. an automobile, from components which are fabricated at a location remote from the assembly plant. As the various components are manufactured, they are placed in welded wire containers and shipped by truck or rail to the assembly plant. Since these articles are generally metal and therefore quite heavy, the containers must be capable of withstanding heavy loads especially, when the loaded containers are nested one on top of the other. Upon arrival at the assembly plant, the stacked or nested containers are normally unloaded by forklift tractors and taken to storage areas where they are restacked until needed on the assembly line.

Preferably, containers of the type described should be collapsible so as to occupy minimum storage space after the containers have been emptied. Furthermore, to facilitate handling and shipment of the empty collapsed containers, means should be provided whereby the containers are nestable in their collapsed condition as well as when fully erect and loaded with parts.

The prior art discloses welded wire containers exhibiting various configurations. For example, U.S. Pat. No. 2,808,122, issued to Marshall H. Beckner, discloses a welded wire container having tapered feet which are insertable in corresponding socket plates, thereby rendering the container nestable. It is to be noted that, however, the container disclosed in the Beckner patent is not collapsible and consequently consumes an inordinate amount of space when stored in an empty condition. Although the prior art does disclose other wire welded containers which are collapsible, see for example U.S. Pat. No. 2,733,828 issued to Charles C. Averill and U.S. Pat. No. 3,478,914 issued to Archie T. Williams, these containers are not stackable or nestable within each other when fully collapsed. This deficiency greatly increases the problems associated with storing, handling and transporting the collapsed containers.

SUMMARY OF THE INVENTION

It is a general object of the present invention to provide a rigid collapsible wire welded container which may be fully collapsed for storage or shipment and which is nestable both when fully collapsed and when fully erect.

Another object of the present invention is the provision of a rigid collapsible wire welded container which may be transported by forklift means, both when fully erect and when fully collapsed. Further specific objects of the present invention include the provision of a rigid collapsible container capable of withstanding heavy loads, including loads associated with similar containers stacked thereupon, while being characterized by a light-weight construction.

In accordance with these and other useful objects, the container of the present invention comprises a rectangularly shaped base member comprising a rectangular frame made up of horizontally oriented side channel elements in parallel spaced relationship and horizontally oriented front and rear channel elements also oriented in parallel spaced relationship. The base member includes a deck structure which is supported between the channel elements and which forms the floor of the container.

A cornerpost extends from each corner of the rectangular base member and includes a vertical lower section and an upper section. Each of the cornerpost lower sections rigidly joins two of the channel elements and has a male nesting means depending therefrom below the base member and a female nesting means at the opposite end thereof. The cornerpost upper sections, also having female nesting means at one end thereof, are pivotally affixed at their lower ends to the cornerpost lower sections and are swingable between a vertical position and a substantially horizontal position overlying the deck structure.

A pair of wire mesh side panels extend between and are each pivotally associated with two of the cornerpost upper sections. Front and rear wire mesh panels extend between the side panels and are hingedly secured to the front and rear channel elements respectively so as to be swingable between a vertical position and a substantially horizontal position overlying the deck structure. Appropriate lock means associated with the front and rear panels and the cornerpost upper sections may be provided for releasably locking the front and rear panels in their vertical position.

Due to the swingable nature of the panels and the nesting means associated with the cornerpost upper and lower sections, it will be appreciated that the container of the present invention is fully collapsible for storage or shipment and furthermore is nestable or stackable both when fully erect and when fully collapsed.

BRIEF DESCRIPTION OF THE DRAWINGS

FIG. 5 is an elevation view of the upper angle iron of the corner posts shown in FIGS. 1 and 4.

FIG. 12 is a plan view taken along line 12-12 in FIG. 11.

DESCRIPTION OF THE PREFERRED EMBODIMENTS

Figure 1:
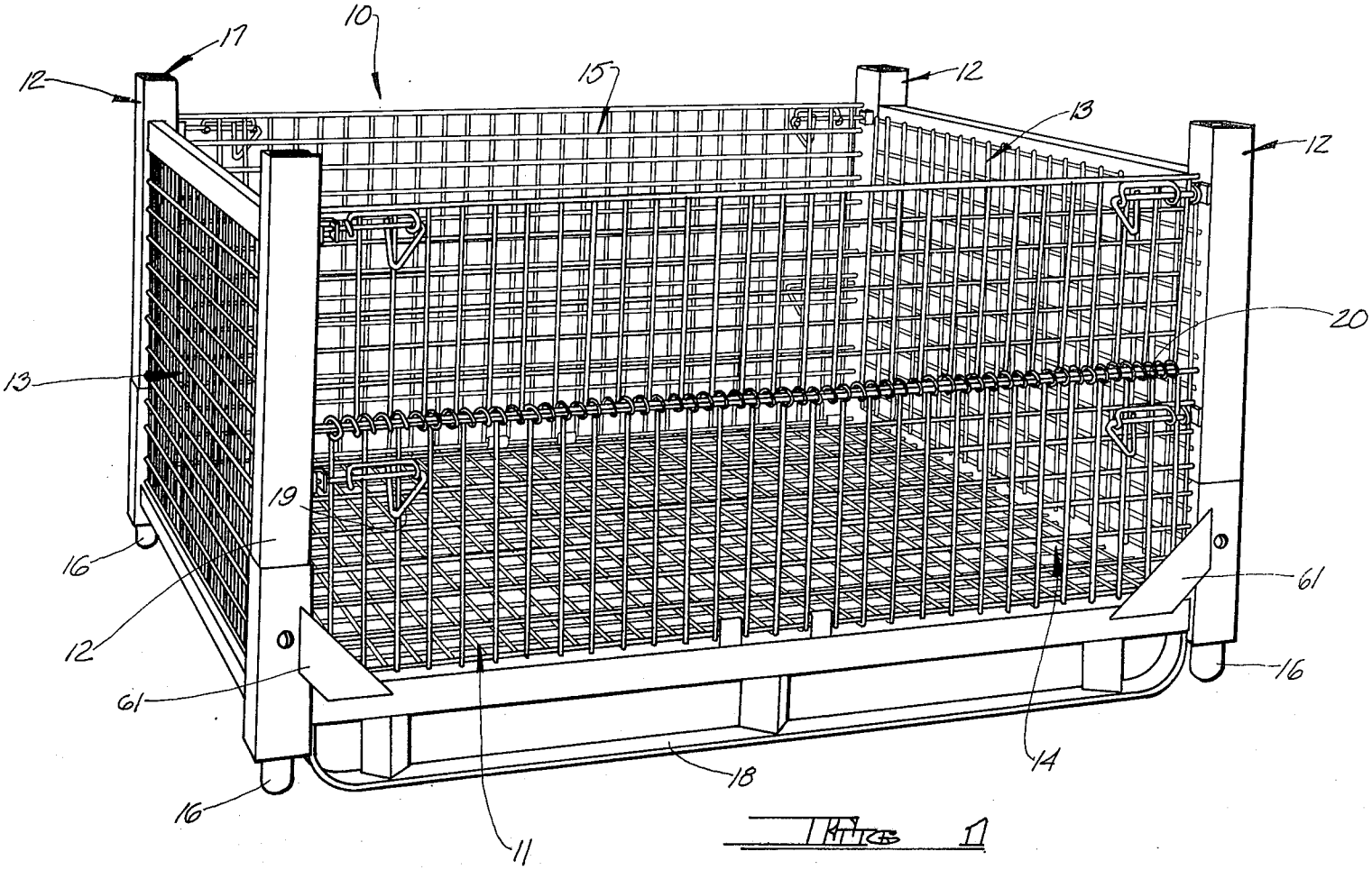
FIG. 1 is a perspective view of the container of the present invention showing the top portion of the front panel in an erect condition.

Turning now to the drawings, FIG. 1 shows the container 10 of the present invention in perspective. In general terms, the container 10 comprises a deck structure 11, four corner posts 12 extending from the deck structure 11, a pair of wire mesh side panels 13 each extending between and securely fastened between two of the corner posts 12, and front and rear panels 14 and 15 respectively hingedly secured to the deck structure 11. Male nesting means or feet 16 depend from the corner posts 12 and are matable with corresponding female nesting means or stacking pockets 17 at the opposite ends of the corner posts 12. A pair of runners 18 depend from the deck structure 11 and underlie the front and rear wire mesh panels 14 and 15. Lock means 19 are provided to maintain the front and rear panels 14 and 15 in erect position and a spiral hinge 20 divides the front panel 14 to facilitate entry into the container 10.

Figure 2:
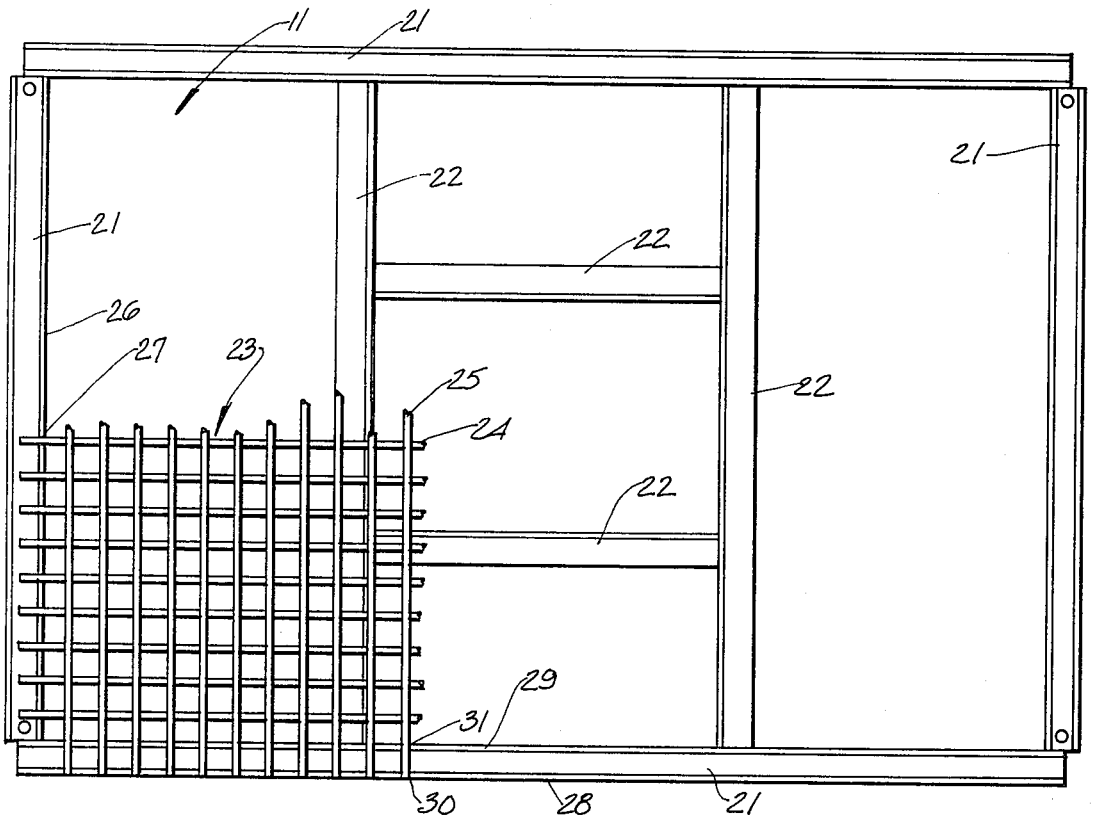
FIG. 2 is a plan view of the deck structure of the container shown in FIG. 1.

As best seen in FIG. 2, the deck structure 11 comprises four rectangularly oriented channel elements 21. A plurality of support elements 22 extend intermediate the channel elements 21 and provide support for the deck structure 11 when heavy articles are placed within the container 10. Although channel elements 21 and support elements 22 may take various forms, such as square or rectangular tubing, in the preferred embodiment shown in FIG. 2 channel elements 21 are U-shaped in construction and support elements 22 are of angle iron cross section. A wire mesh deck panel 23 overlies the channel elements 21 and the support elements 22 and completes the deck structure 11. The wire mesh deck panel 23 which comprises horizontal wires 24 and transverse wires 25 provides a convenient surface upon which articles to be transported or stored in the container 10 may be placed. The horizontal wires 24 of the deck panel 23 may be welded to the inside flanges 26 of the channel elements 21 underlying the side panels 13 as shown at their intersection points 27. Similarly, the transverse wires 25 may be welded to both flanges 28 and 29 of the channel elements 21 underlying the front and rear panels 14 and 15 as shown at the intersection points 30 and 31.

Figure 3:
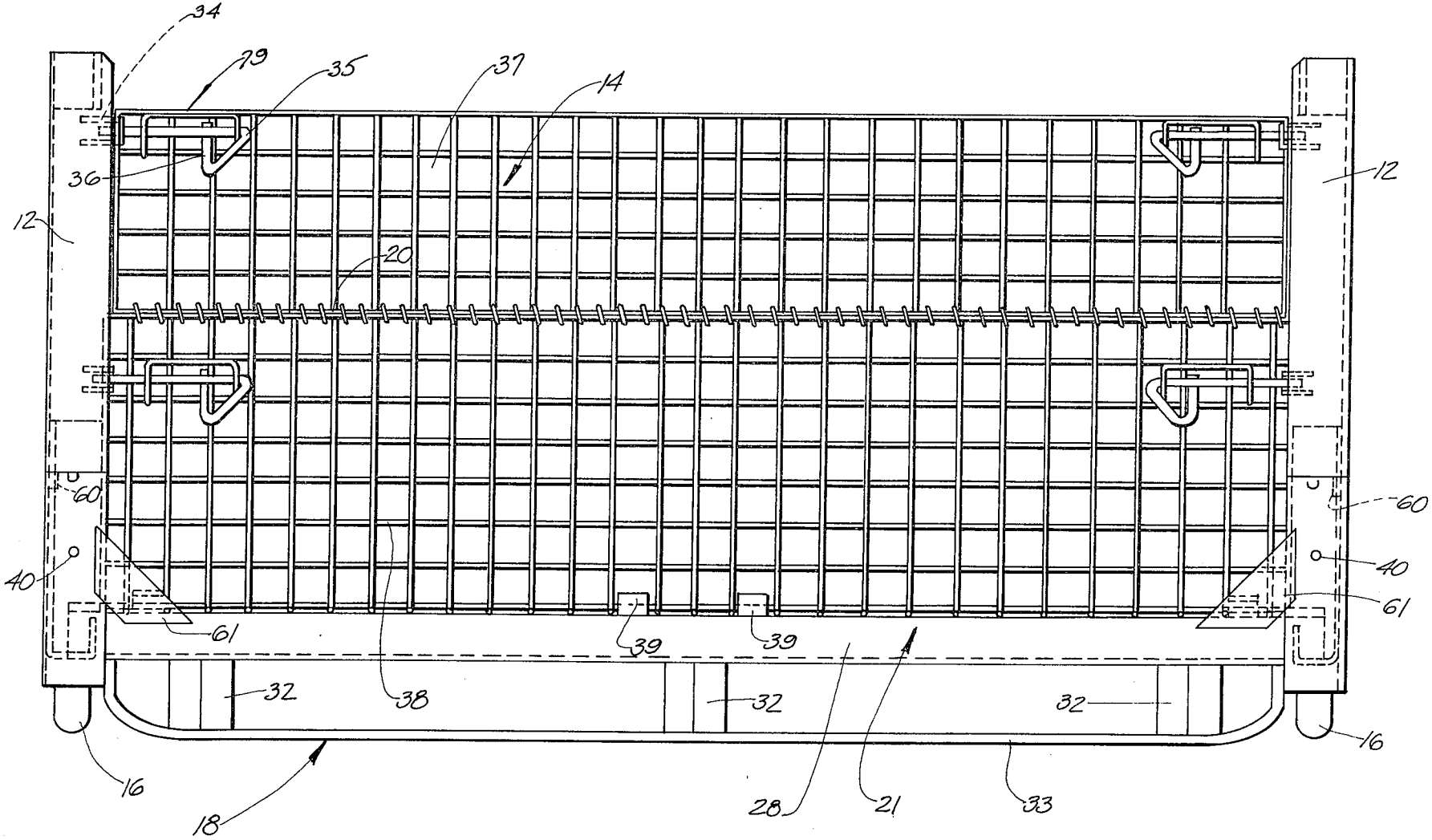
FIG. 3 is a front elevation view of the container of the present invention showing the top portion of the front panel in an erect condition.

Referring to FIG. 3, it will be seen that the runners 18 depend from the channel elements 21 and underlie the front and rear panels 14 and 15. It will be further noted that each runner 18 comprises a truncated U-shaped segment 33 extending between corner posts 12 and joined to channel elements 21 by support structures 32. The runners 18 provide a load bearing surface which makes contact with the surface upon which the container 10 is placed. To prevent the feet 16 from assuming any of the load, a slight clearance must be maintained between their lowermost extensions and the lowermost extension of the U-shaped segment 33 of the runner 18.

The container 10 is shown in FIG. 1 in its fully erect or uncollapsed orientation. In this orientation, the corner posts 12 are fully erect or vertical with respect to the deck structure 11. The front and rear panels 14 and 15 are maintained erect by the locks 19, each of which includes an eye member 34 secured to a corner post 12 and a bolt 35 slidably engageable with the eye 34. It will be noted that when the bolt 35 is fully inserted into the eye 34, the front and rear panels 14 and 15 will be maintained erect whereas when bolt 35 is disengaged from the eye 34, the travel of bolt 35 being limited by the bolt vertical section 36, the panels may be collapsed about their hinge points.

Furthermore, when the upper locks 19 on the front panel 14 are disengaged, the top portion 37 of panel 14 may be pivoted outwardly about spiral hinge 20 thereby allowing convenient access to the interior of the container 10. When the lower locks 19 of the front panel 14 and the locks 19 of the rear panel 15 are disengaged, the lower section 38 of the front panel 14 and the rear panel 15 may be pivoted inwardly about hinges 39 to a position overlying the deck structure 11. To thereafter completely collapse the container 10, the corner posts 12, and their associated side panels 13 are pivoted inwardly about rivets 40 to a position overlying the collapsed front and rear panels 14 and 15 and the deck structure 11.

The construction of the corner posts 12 is more clearly shown in FIGS. 4 through 7. It will be noted that each corner post 12 includes an upper section 41 of angle iron cross section and lower section 42 also of angle iron cross section. The upper angle iron 41 in turn comprises an upper angle iron section 43 and an intermediate angle iron section 44 welded together as at 45. The cross sectional dimensions of upper angle iron 43 is approximately equivalent to the cross sectional dimensions of lower angle iron 42 whereas the cross sectional dimensions of the intermediate angle iron section 44 is somewhat reduced with respect thereto. The stacking pocket 17, see FIG. 8, which comprises a pair of normally oriented walls 45 and 46 is secured to one end of the upper angle iron section 43 to enable nesting of the erect container 10 by insertion therein of the feet 16 of another container 10. As further shown in FIG. 7, the intermediate angle iron section 44 includes an aperture 47 and a skewed slot 48. The functions of aperture 47 and slot 48 will be described in further detail hereinafter.

Figure 6:
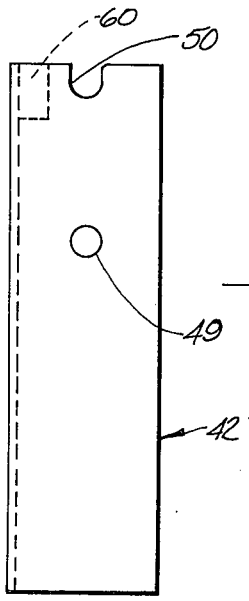
FIG. 6 is an elevation view of the lower angle iron of the corner posts shown in FIGS. 1 and 4.

Referring now to FIG. 6, it will be seen that the lower angle iron 42 includes an aperture 49 and a notch 50 at its upper end. In the assembled corner post 12, see FIG. 4, a rivet 40 is securely attached to the lower angle iron 42 through aperture 49. The rivet 40 is then passed through the skewed slot 48 in the intermediate angle iron section 44 so as to pivotally join the upper angle iron 41 to the lower angle iron 42. Another rivet or pin 51 is securely fastened to the intermediate angle iron section 44 through aperture 47 and rests in notch 50 of the lower angle iron 42.

Figure 4:
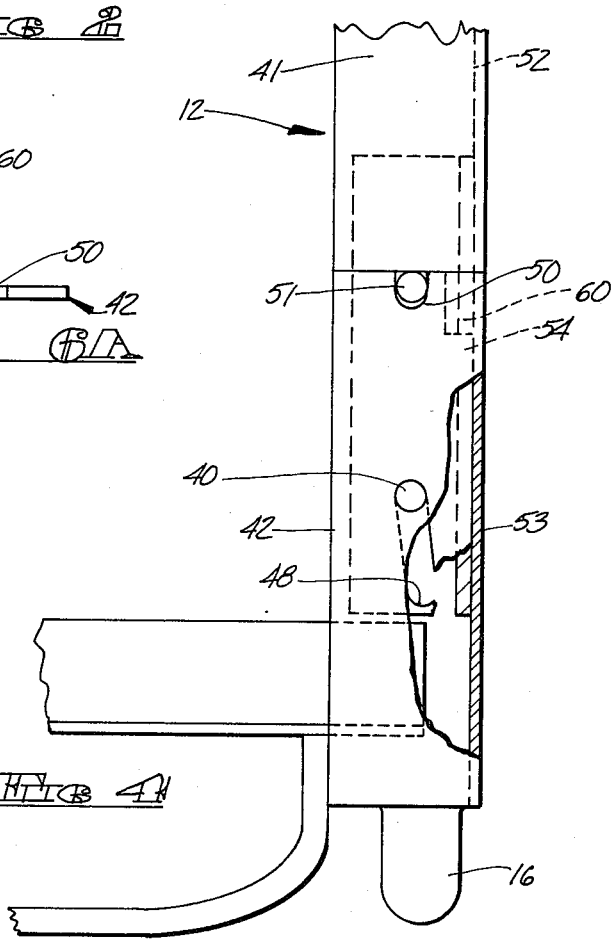
FIG. 4 is a fragmentary front elevation view, partially in cross section, showing the structure of the corner posts of the container shown in FIG. 1.

In FIG. 4, the corner post 12 is shown in its upright or erect position. Rivet 51 rests in notch 50 and the flanged surface 52 of the upper angle iron 41 is in abutment with the flanged surface 53 of the lower angle iron 42. Also, the rivet 40 is seated at the uppermost end of skewed slot 48. To collapse the corner posts 12, and consequently the side panels 13 securedly affixed therebetween, the intermediate angle iron sections 44 are raised by manually raising the upper angle irons 41.

In this manner, rivet 51 is unseated from its rest position in notch 50 and skewed slot 48 is raised upward relative to rivet 40 until rivet 40 reaches the lowermost position in skewed slot 48. The inner angle irons 41 may then be inwardly collapsed by pivoting about rivet 40 to a position overlying the previously collapsed front and rear panels 14 and 15 as well as the deck structure 11. The angle of skew of slot 48 assures an adequate clearance between the flanged surface 54 of the intermediate angle iron section 44 and the flanged surface 52 of the lower angle iron 42 during this pivotal action.

Figures 7, 8, 9, 10, 11:
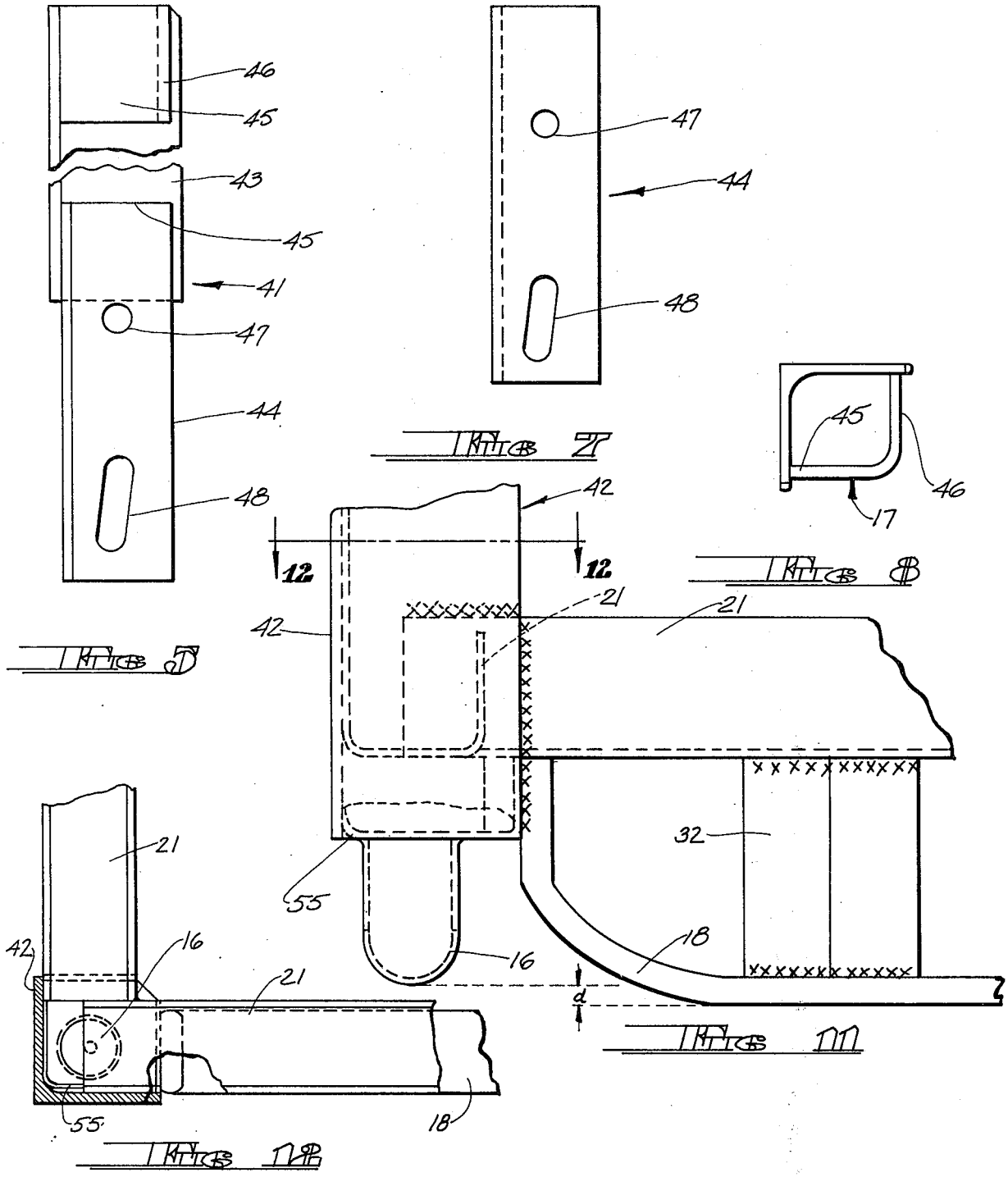
FIG. 7 is an elevation view of the lower section of the upper angle iron shown in FIG. 5.
FIG. 8 is a plan view showing the structure of the corner post stacking pockets.
FIG. 9 is a front elevation view showing two collapsed containers in the nested relationship and exhibiting an overlap condition.
FIG. 10 is a front elevation view showing two other collapsed containers in nested relationship exhibiting a condition where no overlap occurs.
FIG. 11 is a fragmentary front elevation view particularly showing the intersection of a corner post with a channel element of the deck structure of the container of the present invention.
Figure 8:
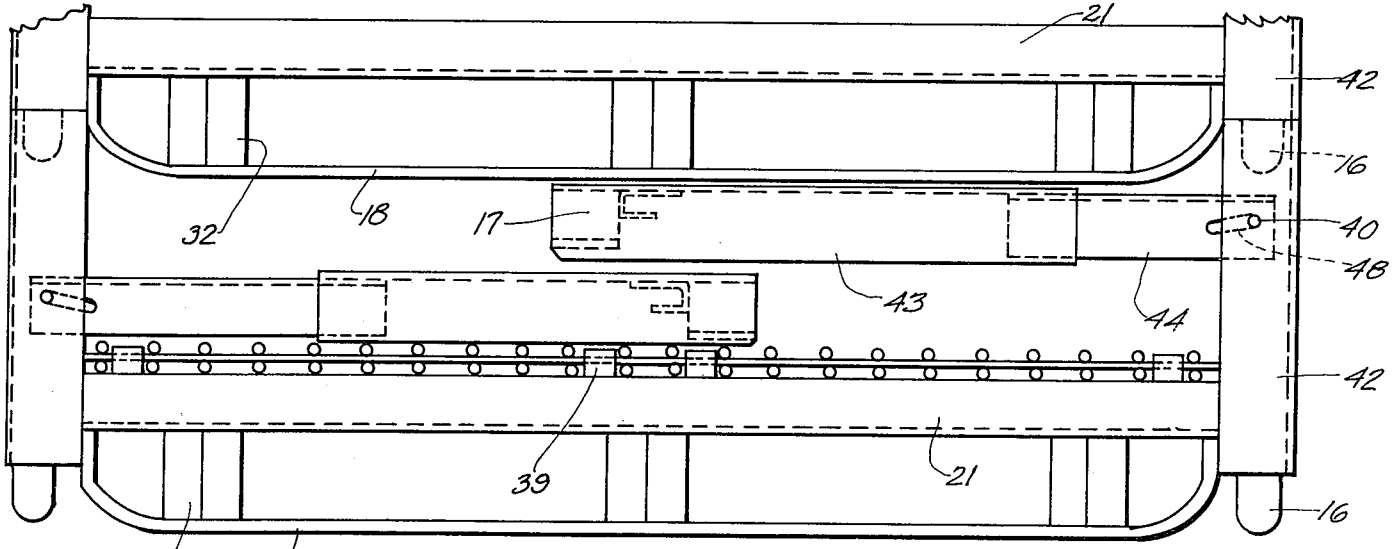
Figure 10:
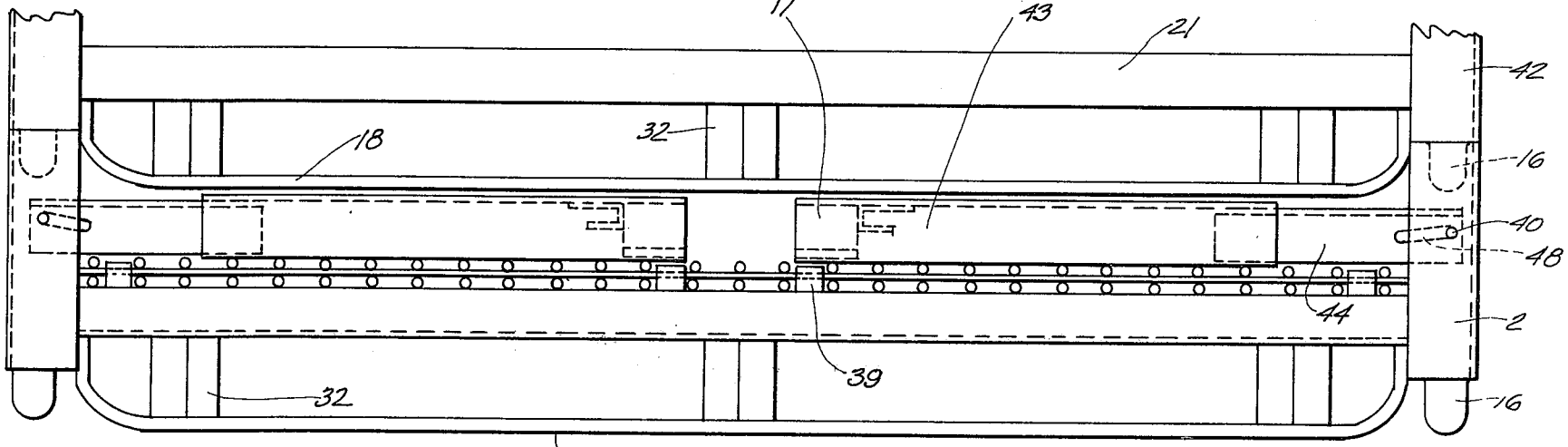

The fully collapsed containers 10 are shown in FIGS. 9 and 10. It will be noted that the collapsed corner posts 12 overlie the front and rear panels 14 and 15, which overlie the deck structure 11. Furthermore, it will be noted that the containers 10 in their fully collapsed condition, can be nested or stacked one upon the other by inserting feet 16 of one container 10 between the flanged surfaces of the lower angle iron 42 of a second container 10 and allowing the lower surface of the first lower angle iron 42 to rest upon the upper surface of the second lower angle iron 42. In FIG. 10, the width W of the container 10 is sufficient so that the corner posts 12 may be collapsed without any resultant overlap. However, in the case of a container 10 which has a smaller width, as depicted in FIG. 9, an overlap between corner posts 12 (when collapsed) may occur. In this event, the lower angle irons 42 must be somewhat increased in length and their pivot points about rivet 40 must be staggered as shown in order to achieve a proper nesting capability.

In order to re-erect the containers 10 the upper angle irons 41 are pivoted outwardly about rivets 40. This pivotal action causes the skewed slots 48 to move relative to the rivets 40 such that rivets 40 are displaced from their lowermost positions in slots 48 (in which they were located when the container 10 was collapsed) to their uppermost positions as shown in FIG. 4. As a result of the angle of skew of slot 48, the flanges of the intermediate angle iron sections 44 are wedged into abutment with the flanges of the lower angle iron 42 to provide support for the erect corner posts 12. Also, it will be noted that rivet or pin 51 is seated in notch 50 so as to help maintain the upper angle iron 41 locked in its vertical position.

Referring to FIGS. 11 and 12, it will be noted that each lower angle iron 42 securely joins a pair of channel elements 21 at right angles to each other. The channel elements 21 may be secured to the lower angle irons 42 by welding the members together or by other appropriate means. As most clearly shown in FIG. 11, the runner 18 extends somewhat beyond the lowermost extension of the nesting cap 16. As previously mentioned, this is done to assure that the runners 18 will provide the floor bearing surface for the container 10. Finally, it will be noted that the nesting caps or feet 16 are secured to the lowermost ends of the lower angle irons 42 by means of a nesting cap insert 55 which may be welded to the inside surfaces of the flanges of lower angle iron 42. In this manner, the nesting cap inserts 55 securely fasten the nesting caps 16 to the lower angle irons 42.

Figure 13:
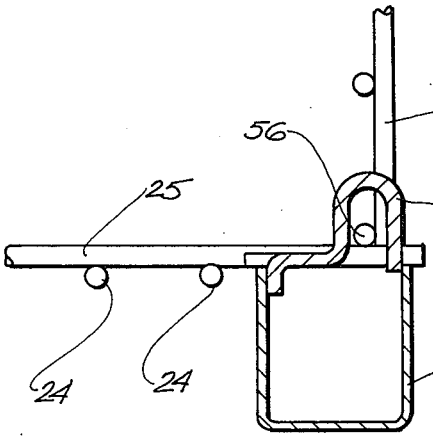
FIG. 13 is a fragmentary side elevation view, partially in cross section, showing the hinge structure of the container of the present invention.
Figure 14:
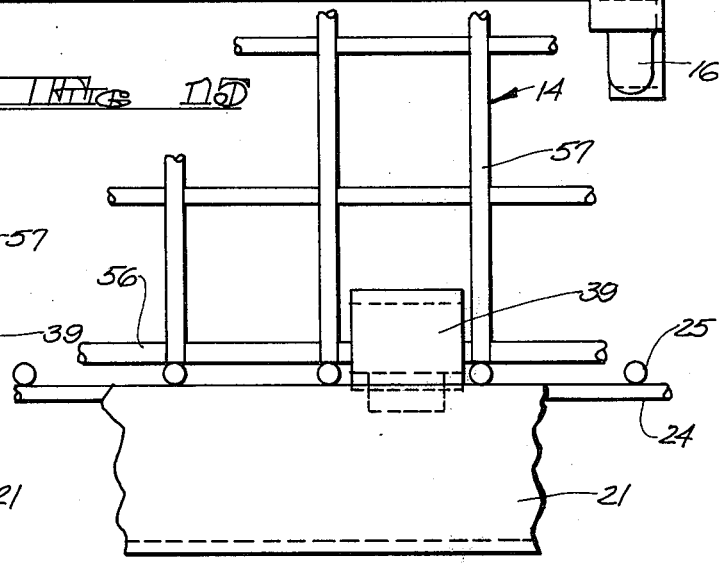
FIG. 14 is a front elevation view corresponding to FIG. 13.

FIGS. 13 and 14 particularly show the relationship between the hinges 39, the front panel 14 and the deck structure 11. It will be appreciated that a similar relationship exists between the rear panel 15, the channels 21 and the hinges 39. As shown, the lowermost horizontal wire 56 of the front panel 14 extends through hinge 39 to enable the front panel 14 to pivot inwardly about hinge 39. The horizontal wire 56 rests directly upon the transverse wires 25 of the deck structure 11 which, in turn, rest upon the horizontal wires 24 of the deck structure 11. Also, it will be noted that the vertical wires 57 of the front panel 14 sit directly upon the transverse wires 25 of the deck structure 11. While the wires 24 and 25 of the deck structure 11 may be welded to the channel elements 21, the wires 56 and 57 of the front panel 14 merely rest upon the deck structure 11 to allow for the necessary pivotal action.

Figure 15:
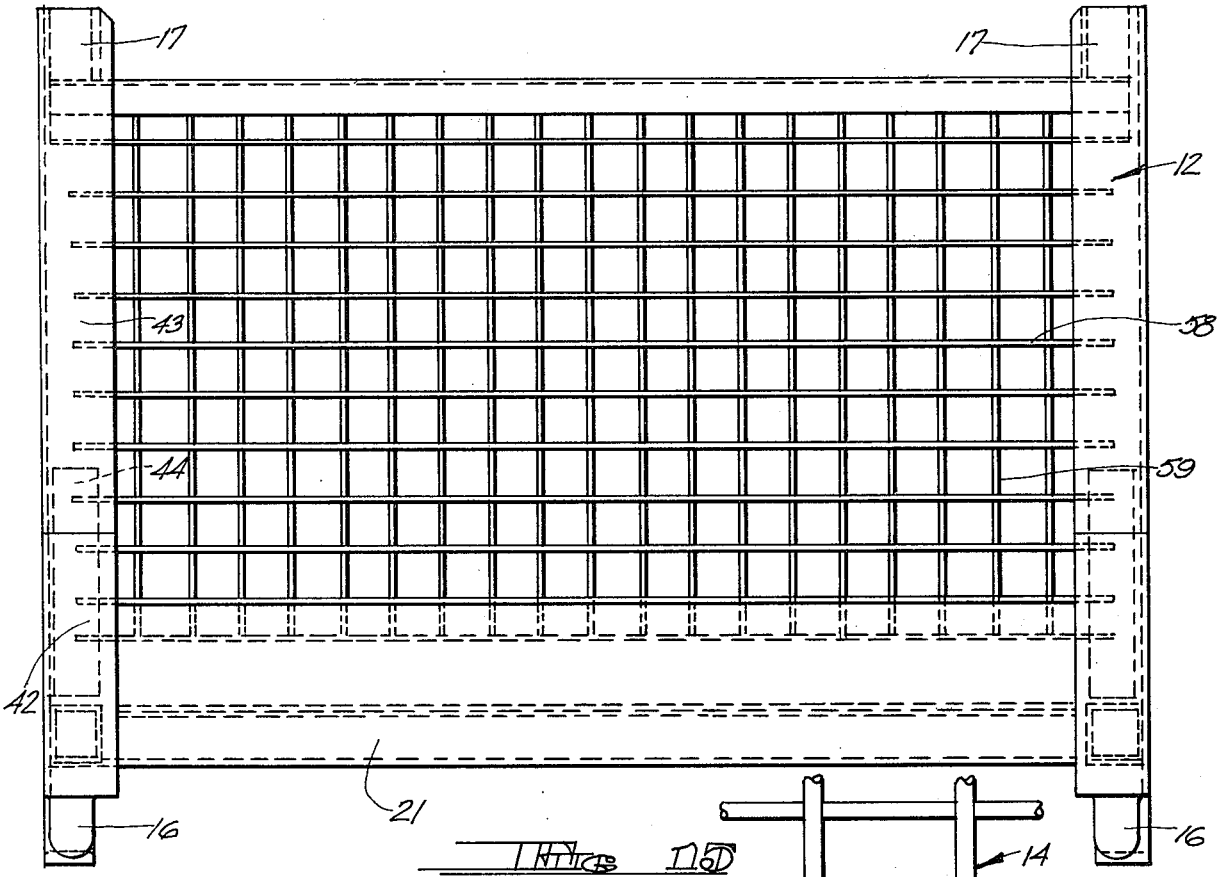
FIG. 15 is a side elevation view of the container of the present invention.

Finally, FIG. 15 shows the detailed construction of the side panels 13. The horizontal wires 58 of the side panels 13 are securely fastened to the corner posts 12 by welding or the like. Racking of the side panels 13, i.e. the bowing out of their center sections due to a load within the container 10, is largely reduced by means of the joint between the horizontal wires 58 and the angle iron cross sections corner posts 12. In this respect, it will be noted that the horizontal wires 58 of the side panels 13 somewhat overlap one flange of the corner posts 12 to provide this anti-racking capability. Also, it will be appreicated that by securely fastening the side panels 13 to the corner posts 12, the former are in pivotal association with the latter and are therefore collapsible as an integral unit.

Figure 6A:
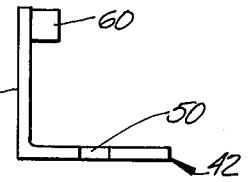
FIG. 6A is a plan view of the lower angle iron shown in FIG. 6.

The container 10 of the present invention is characterized by a rigid construction due to the inclusion of the angle iron corner posts 12 which assume substantially all of the vertical forces when the containers 10, either collapsed or uncollapsed, are stacked or nested one upon the other. Accordingly, the vertical wires 59 of the side panels 13 as well as the vertical wires 57 of the front and rear panels 14 and 15, have only horizontal forces acting against them and the deck structure 11 has only vertical forces acting against it from the weight of the contents of the container. Vertical forces from the weight of stacked containers and their contents are supported entirely by the corner posts. And again, the former is true regardless of whether the containers 10 are stacked in their uncollapsed or fully collapsed conditions. For example, appropriate stop blocks 60 (see FIGS. 6 and 6A) may be welded to the top of the flanged surface 53 of the lower angle irons 42 to provide additional surface area for insuring stable and secure nesting when the containers 10 are stacked in their collapsed conditions. Also, gusset plates 61 (see FIGS. 1 and 3) may be included for structural support between lower angle irons 42 and the flanges 28 of channel element 21.

It is to be understood that the form of the invention herewith shown and described is to be taken as a preferred embodiment of the same, and that various changes in the shape, size and arrangement of parts may be resorted to, without departing from the spirit of the invention or scope of the subjoined claims.

The embodiments of the invention in which an exclusive property or privilege is claimed are defined as follows:

1. A rigid collapsible container comprising:

a. a rectangularly shaped base member having upstanding corner posts at each of the corners thereof, said corner posts being pivotal about a point near said base member from a vertical position to a position overlying said base member and including male nesting means extending below said base member and female nesting means for mating with said male nesting means when said corner posts are in said vertical position and in said position overlying said base member;

b. a pair of side panels each extending between and pivotally associated with a pair of said corner posts; and c. front and rear panels extending between said side panels and hingedly secured to said base member, said front and rear panels being swingable between a vertical position and a position overlying said base member.

2. A rigid collapsible container comprising:

a. a rectangularly shaped base member comprising a rectangular frame made up of horizontally oriented side channel elements in parallel spaced relationship and horizontally oriented front and rear channel elements in parallel spaced relationship, said base member including a deck structure supported by said channel elements;

b. a corner post at each of the corners of said rectangular base member, each of said corner posts having a vertical lower section and an upper section, each of said lower sections rigidly joining two of said channel elements and having male nesting means depending therefrom below said base member and female nesting means at the top thereof, said upper section being pivotally affixed at its lower end to said lower section and being swingable between a vertical position and a position overlying said deck structure, said upper section including female nesting means at its upper end;

c. a pair of side panels each extending between and pivotally associated with a respective pair of said corner post upper sections, and d. front and rear panels extending between said side panels and hingedly secured to said front and rear channel elements respectively, said front and rear panels being swingable between a vertical position and a horizontal position overlying said deck structure whereby, said container is nestable with like containers when said corner post upper sections and said front and rear panels are in said vertical positions and when said corner posts upper sections and said front and rear panels are in said positions overlying said deck structure.

3. The container according to claim 2 including lock means associated with said front and rear panels and said corner post upper sections for releasably locking said front and rear panels in said vertical position.

4. The container according to claim 3 wherein said corner post upper sections include an intermediate section depending therefrom, said intermediate section being nestable in said upper and lower sections and permanently affixed to said upper section and pivotally associated with said lower section.

5. The container according to claim 4 wherein said upper, lower and intermediate sections are of angle iron cross section each having a first leg in parallel spaced relationship with said front and rear panels and a second leg in parallel spaced relationship with said side panels, each of said lower sections being substantially equivalent in dimension to its respective upper section and being somewhat greater in dimension than its respective intermediate section.

6. The container according to claim 5 wherein each one of said first legs of said lower sections include pivot means extending therethrough and wherein each one of said first legs of said intermediate sections includes an elongated slot for matably receiving a respective one of said pivot means, each of said slots comprising an upper end and a lower end, each of said lower ends terminating near the free end of its respective intermediate section and each of said upper ends being spaced therefrom, each of said elongated slots being skewed such that the lower ends thereof are angled toward the second leg of its respective intermediate section, whereby when said side panels are pivoted about said pivot means from said position overlying said deck structure to said vertical position, each of said elongated slots moves relative to its respective pivot means such that each of said pivot means is displaced from the lower end of its respective elongated slot to the upper end thereof forcing each of said intermediate legs into abutment with its respective lower leg by wedging action wherein each of said upper sections rest upon its respective lower section, and when said side panels are pivoted about said pivot means from said vertical position to said position overlying said deck structure, each of said intermediate sections are initially raised causing each of said elongated slots to move relative to its respective pivot means such that each of said pivot means is displaced from the upper end of its respective elongated slot to the lower end thereof such that pivotal clearance is provided between each of said intermediate sections and its respective lower section for subsequent pivoting of said intermediate sections with respect to said lower sections.

7. The container according to claim 6 wherein each of said pivot means comprises a rivet securely fastened to and extending through its respective lower section and in parallel spaced relationship with the second leg thereof.

8. The container according to claim 6 wherein each one of said first legs of said lower sections includes a notch in its end opposite said deck structure and wherein each of said intermediate sections includes pin means fastened to and extending therethrough, each of said pin means being seatable in its respective notch for maintaining said upper and intermediate sections locked in their vertical positions.

9. The container according to claim 8 wherein each one of said pivot means lies in a plane parallel to said deck structure and wherein said side panels, in said positions overlying said deck structure, are disposed in opposed co-planar relationship.

10. The container according to claim 8 wherein the pair of said pivot means associated with a first one of said side panels define a first common axis disposed from said deck structure and wherein the pair of said pivot means associated with the other of said side panels define a second common axis disposed from said deck structure by a distance greater than said first common axis, whereby when said side panels are in said positions overlying said deck structure a portion of said other side panel overlies a portion of said first side panel.

* * * * *